US005566904A

United States Patent [19]

Hashimoto

[11] Patent Number: 5,566,904

[45] Date of Patent: Oct. 22, 1996

[54] METHOD FOR SEQUENTIALLY WINDING ELASTIC YARN ON A PLURALITY OF BOBBIN HOLDERS

[75] Inventor: Kinzo Hashimoto, Kyoto, Japan

[73] Assignee: Murata Kikai Kabushiki Kaisha, Kyoto, Japan

[21] Appl. No.: 227,459

[22] Filed: Apr. 14, 1994

[30] Foreign Application Priority Data

Apr. 23, 1993 [JP] Japan ..... 5-120792
Oct. 18, 1993 [JP] Japan ..... 5-284534

[51] Int. Cl.[6] ..... B65H 54/00; B65H 67/044

[52] U.S. Cl. ..... 242/18 A; 242/25 A; 242/35.5 T

[58] Field of Search ..... 242/18 A, 28 A, 242/35.5 T

[56] References Cited

U.S. PATENT DOCUMENTS

| | | | |
|---|---|---|---|
| 4,069,984 | 1/1978 | Kline et al. | 242/18 A |
| 4,210,293 | 7/1980 | Fromaget | 242/18 A |
| 4,491,282 | 1/1985 | Hubner | 242/18 A |
| 5,016,829 | 5/1991 | Schippers et al. | 242/18 A |
| 5,318,232 | 6/1994 | Busenhart et al. | 242/18 A |

FOREIGN PATENT DOCUMENTS

| | | | |
|---|---|---|---|
| 359453 | 3/1990 | European Pat. Off. | 242/35.5 T |
| 3236014 | 12/1983 | Germany | 242/18 A |
| 231771 | 9/1989 | Japan | 242/35.5 T |
| 267270 | 10/1989 | Japan | 242/35.5 T |
| 4-341470 | 11/1992 | Japan | 242/35.5 T |
| 5078012 | 3/1993 | Japan | 242/35.5 T |

*Primary Examiner*—William Stryjewski
*Attorney, Agent, or Firm*—Armstrong, Westerman, Hattori, McLeland & Naughton

[57] ABSTRACT

An elastic yarn winding method for winding an elastic yarn in succession by a plurality of bobbin holders, and for transferring a continuously running elastic yarn from a full bobbin to an empty bobbin. The method comprises steps of putting, along a surface of the empty bobbin in some area, the elastic yarn between the full bobbin and the empty bobbin, and of contacting the elastic yarn between the full bobbin and empty bobbin with the elastic yarn present at the upstream side of the empty bobbin. A winder for processing the method provides a yarn transfer device for winding the elastic yarn on the empty bobbin and for holding the elastic yarn in contact with the elastic yarn present at the upstream side of the empty bobbin.

5 Claims, 5 Drawing Sheets

METHOD FOR SEQUENTIALLY WINDING ELASTIC YARN ON A PLURALITY OF BOBBIN HOLDERS

BACKGROUND OF THE INVENTION

1. Field of the Invention

The present invention relates to a method for winding an elastic yarn and to an elastic yarn winder which is capable of taking up the elastic yarn such as a polyurethane yarn alternately by two bobbin holders and transferring a continuously running elastic yarn from a full bobbin over to an empty bobbin.

2. Description of the Related Art

First, the basic constitution of an elastic yarn winder will be explained by referring to FIG. 6. The winder is provided with a lifting box 1 vertically movably mounted on a machine frame 7, and a rotatable turret 2.

In the lifting box 1 are supported a touch roller 3 and a traversing device 4. The touch roller 3 is constantly pressed against a yarn layer wound on a bobbin B located in the winding position described later, driving the bobbin B in a counterclockwise direction. The traversing device 4 is provided with a traverse guide 6, which reciprocates within a traverse range while guiding the yarn Y transversely.

The turret 2 is rotatable by a spindle not shown, on the center of a rotating shaft 14 and is driven by an induction motor 17. Two bobbin holders 15 and 16 are rotatably supported on the turret 2, each of the bobbin holders 15 and 16 holding a few bobbins B (only two bobbins are shown for simplification). The bobbin holder 15 is mounted in the winding position a and the other bobbin holder 16, in the waiting position b.

The turret 2 rotates through 180 degrees when the bobbin B in the winding position a has become full of the yarn Y, changing the positions of the bobbin holders 15 and 16; that is, the full bobbin B is placed in the waiting position b, while the empty bobbin B is set in the winding position a. At the stage that these bobbins B are set in their new positions, however, the yarn Y to be fed is still connected with the full bobbin B in the waiting position b. The empty bobbin B then catches and cuts the yarn Y, and starts winding, thus completing yarn transfer from the full bobbin B to the empty bobbin B.

A common yarn Y, such as a nylon and a polyester yarn, is led into a slit not shown which is provided in the bobbin B, where the yarn is caught and cut with a tension caused by the rotation of the empty bobbin B, on which the yarn is thus taken up.

In the case of cutting and changing an elastic yarn such as a polyurethane yarn between the bobbins B using the slit, however, a failure in yarn transfer occurs frequently. The elastic yarn extends like a rubber thread, decreasing in sectional area. Therefore, when the winding of the elastic yarn on the empty bobbin B starts after entering the slit, the elastic yarn is pulled to extend, becoming smaller in sectional form and accordingly easily movable in the slit. The yarn therefore slips in the slit, failing in transferring the yarn to the empty bobbin B.

To the elastic yarn, therefore, a method for yarn transfer as shown in FIG. 6 is adopted. The surface of the empty bobbin B is applied with plastics coating, to thereby make the elastic yarn easily attachable on the surface of the empty bobbin B. Also, the turret 2 is turned in a counterclockwise direction which is opposite to a normal direction of rotation, thus changing the relation between the empty bobbin B and the yarn Y from reverse winding to normal winding. Furthermore, for a spindle not shown, a quick-braking system is provided to stop a bobbin holder 16 for holding the full bobbin B in the waiting position.

When yarn transfer is effected from a full bobbin B to an empty bobbin B, the turret 2 is rotated in the direction illustrated. The elastic yarn Y runs while being pressed against the surface of the empty bobbin B, drawing a path to the full bobbin B off the empty bobbin B. The empty bobbin B is plastics-coated on the surface, so that the elastic yarn Y will adhere on the surface of the empty bobbin B, being snapped and wound until the empty bobbin B becomes full. In this state, the bobbin holder 16 holding the full bobbin B is quickly decelerated (the bobbin holder 15 of the empty bobbin B is normally rotating). Then, the elastic yarn between the empty bobbin B and the full bobbin B is slackened. However, the elastic yarn Y, holding on the surface of the empty bobbin B, is attracted to the empty bobbin B as indicated by a dotted line, and is cut between the empty bobbin B and the full bobbin B after making one turn around the empty bobbin B, thus being wound on the empty bobbin B. The yarn transfer is done in this manner by utilizing the property of the elastic yarn Y that the elastic yarn Y is easy to adhere to the empty bobbin B due to a great friction coefficient.

However, the above-described method of yarn transfer requires quick deceleration of the bobbin holder 16 on the full bobbin B side at the time of yarn transfer; actually only a motor for electrical braking is not enough to quickly stop the full bobbin B having a great inertia gravity, and it is necessary to provide the spindle with a large-scale mechanical braking system, which, however, has such a problem that winder construction will become complicated. There also exists such a problem that a thick elastic yarn easily becomes slackened because its adhesion increases little as compared with the inertia force acting to throw the yarn off the empty bobbin, consequently failing in yarn transfer from a full bobbin to an empty bobbin. Furthermore, in the case of little adhesion of the elastic yarn which therefore can not hold well on the bobbin surface, or in the case of an elastic yarn which is too thick to fit in the slit provided in the bobbin surface, the above-described method of yarn transfer is not suitable.

SUMMARY OF THE INVENTION

In view of the above-described problems inherent in the heretofore known art, it is an object of the present invention to provide an elastic yarn winder of a simple construction which can transfer an elastic yarn properly from a full bobbin to an empty bobbin.

To insure the transfer of the elastic yarn, it is important to hold the yarn stretched between an empty bobbin and a full bobbin in proper contact with the yarn at the upstream side of the empty bobbin. The present invention, therefore, has a first means of solution by which the yarn between the empty bobbin and the full bobbin is held in contact, or preferably in forced contact, with the upstream yarn of the empty bobbin. In order to accomplish the object stated above, the elastic yarn winder is provided with a plurality of bobbin holders by which an uninterruptedly running elastic yarn is taken up in succession, being transferred from a full bobbin to an empty bobbin. That is, the winder is equipped with a yarn transfer device for winding, on the empty bobbin, the elastic yarn which is running to the full bobbin in the waiting position through the empty bobbin in the winding position, and then for holding the elastic yarn in contact with the elastic yarn at the upstream side of the empty bobbin.

When the elastic yarn between the empty bobbin and the full bobbin is wound on the empty bobbin by means of the yarn transfer device and further brought into contact with the upstream elastic yarn of the empty bobbin, the elastic yarns will twine together, so that the elastic yarn between the empty bobbin and the full bobbin will be cut, thus completing yarn transfer.

The present invention has the second means of solution that a gap is provided between the empty bobbin and a touch roll through which yarn transfer is done, to thereby facilitate the contact of the yarn between the empty bobbin and the full bobbin with the yarn at the upstream side of the empty bobbin.

Next, concretely explained is the method of winding the elastic yarn. An elastic yarn is taken up on an empty bobbin located in the winding positions of a pair of bobbin holders, and when the bobbin has become full of the yarn, the bobbin holders are changed between the waiting position and the winding position to switch the elastic yarn from the full bobbin to an empty bobbin. In this elastic yarn winding method, the empty bobbin is stopped in an intermediate position past the winding position, and in this intermediate position yarn transfer is done by winding the elastic yarn on the outgoing side of the empty bobbin around the bobbin.

In the elastic yarn winder an elastic yarn is taken up on an empty bobbin located in the winding positions of a pair of bobbin holders, and when the bobbin has become full of the yarn, the bobbin holders are changed between the waiting position and the winding position to switch the elastic yarn from the full bobbin to an empty bobbin. This elastic yarn winder has a stop means for stopping the empty bobbin in an intermediate position past the winding position, and a yarn transfer means for winding the elastic yarn on the outgoing side of the empty bobbin around the bobbin in the intermediate position, thus bringing the yarn into contact with an elastic yarn on the incoming side.

When the elastic yarn between the empty bobbin and the full bobbin is wound around the empty bobbin by the yarn transfer means, the elastic yarn attaches on the empty bobbin with its adhesion, coming, while turning, into contact with another elastic yarn entering the empty bobbin. The yarns are intertwined with each other until the elastic yarn between the empty bobbin and the full bobbin is the yarn transfer is finished. And yarn transfer can be reliably effected by a yarn transfer means, such as a yarn transfer device for winding the elastic yarn around the empty bobbin and bringing the elastic yarn into contact with the incoming elastic yarn. The winding angle of the elastic yarn on the empty bobbin is increased greater by stopping the empty bobbin in the intermediate position past the winding position than by stopping for example in the winding position; and accordingly the winding angle required for bringing the outgoing elastic yarn into contact with the incoming elastic yarn decreases, ensuring easy and reliable yarn transfer.

DESCRIPTION OF THE PREFERRED EMBODIMENT

Figure 1:
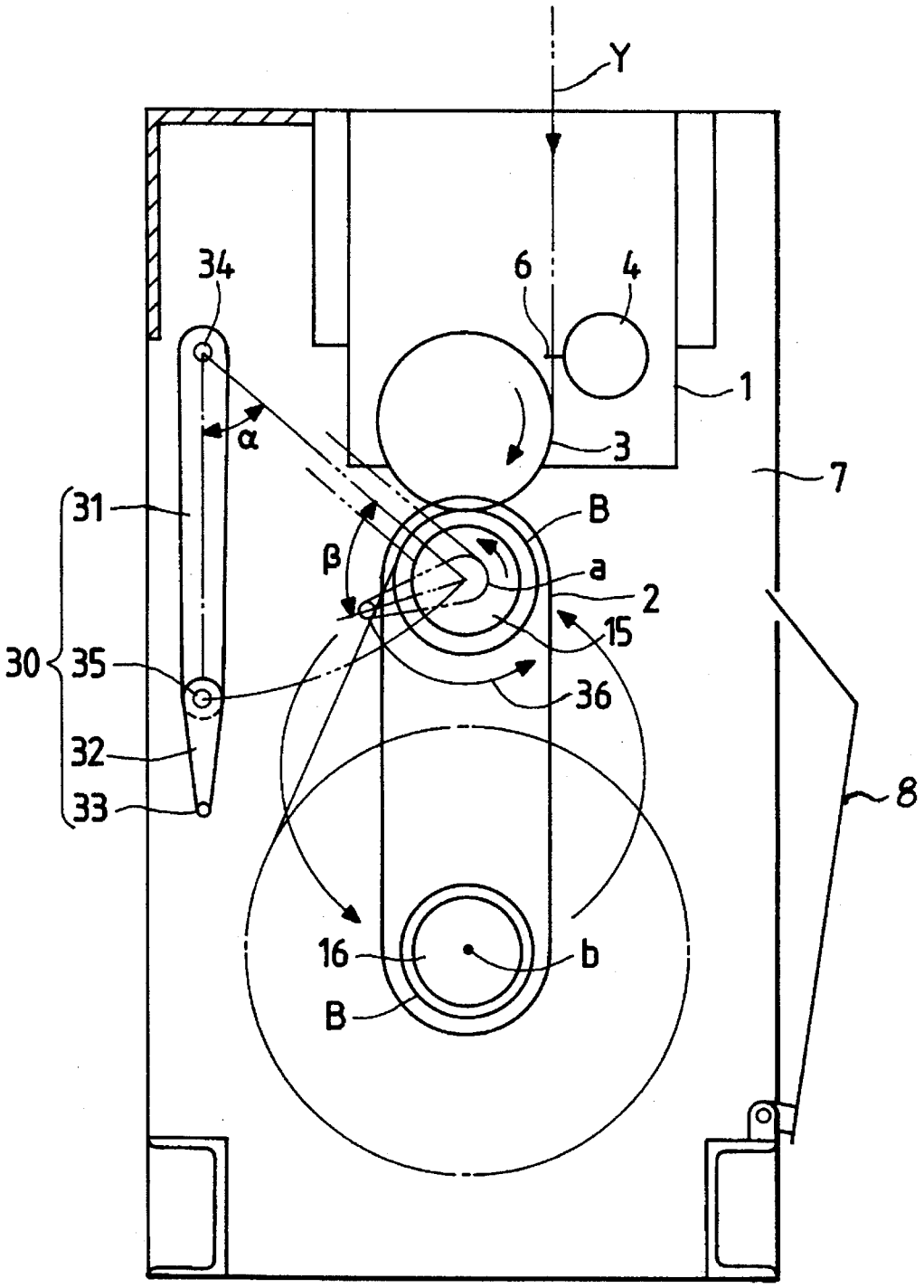
FIG. 1 is a front view of a first embodiment of a winder according to the present invention.
Figure 2:
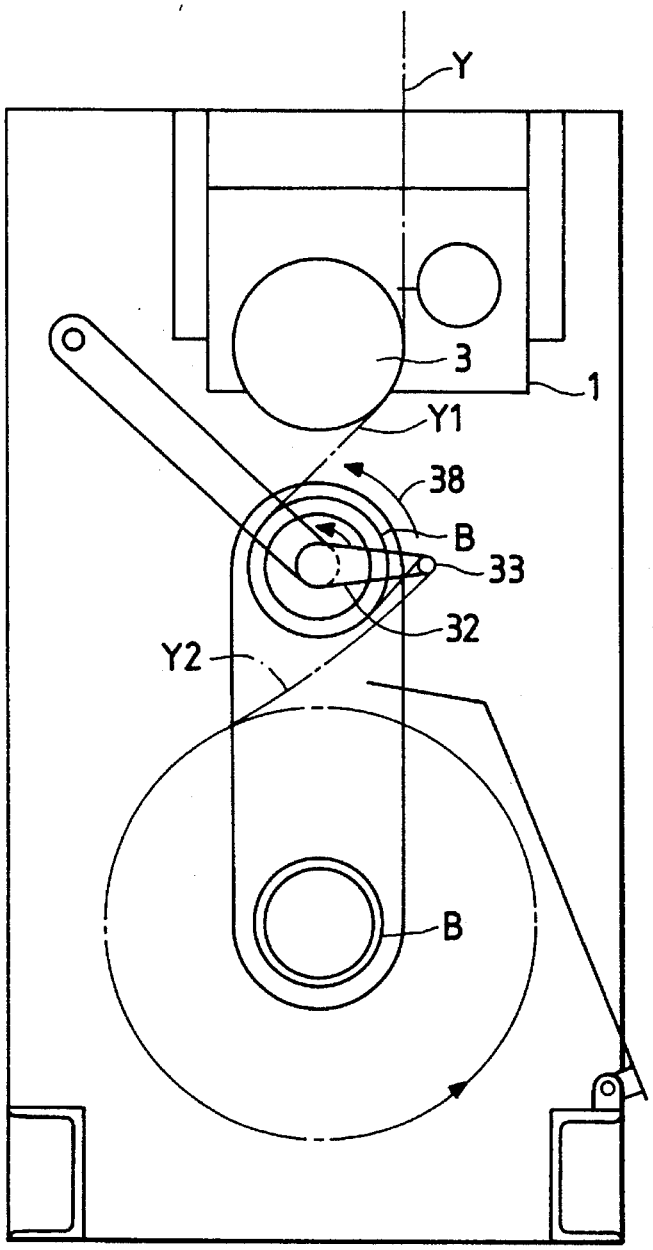
FIG. 2 is a front view of the winder showing the state of yarn transfer.
Figure 3:
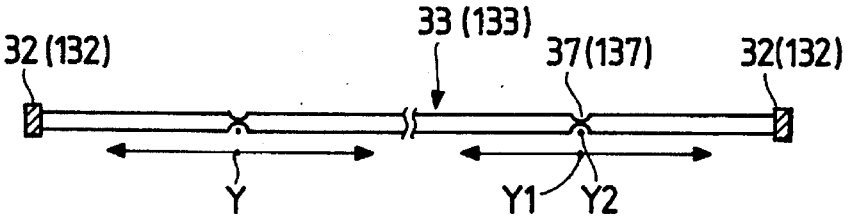
FIG. 3 is a top view of a major portion of a yarn transfer device.

Hereinafter a first embodiment of an elastic yarn winder according to the present invention will be explained with reference to the accompanying drawings. FIG. 1 is a front view of the first embodiment of the winder; FIG. 2 is a front view of the winder showing the state of yarn transfer; and FIG. 3 is a top view of a major portion of a yarn transfer device.

Figure 6:
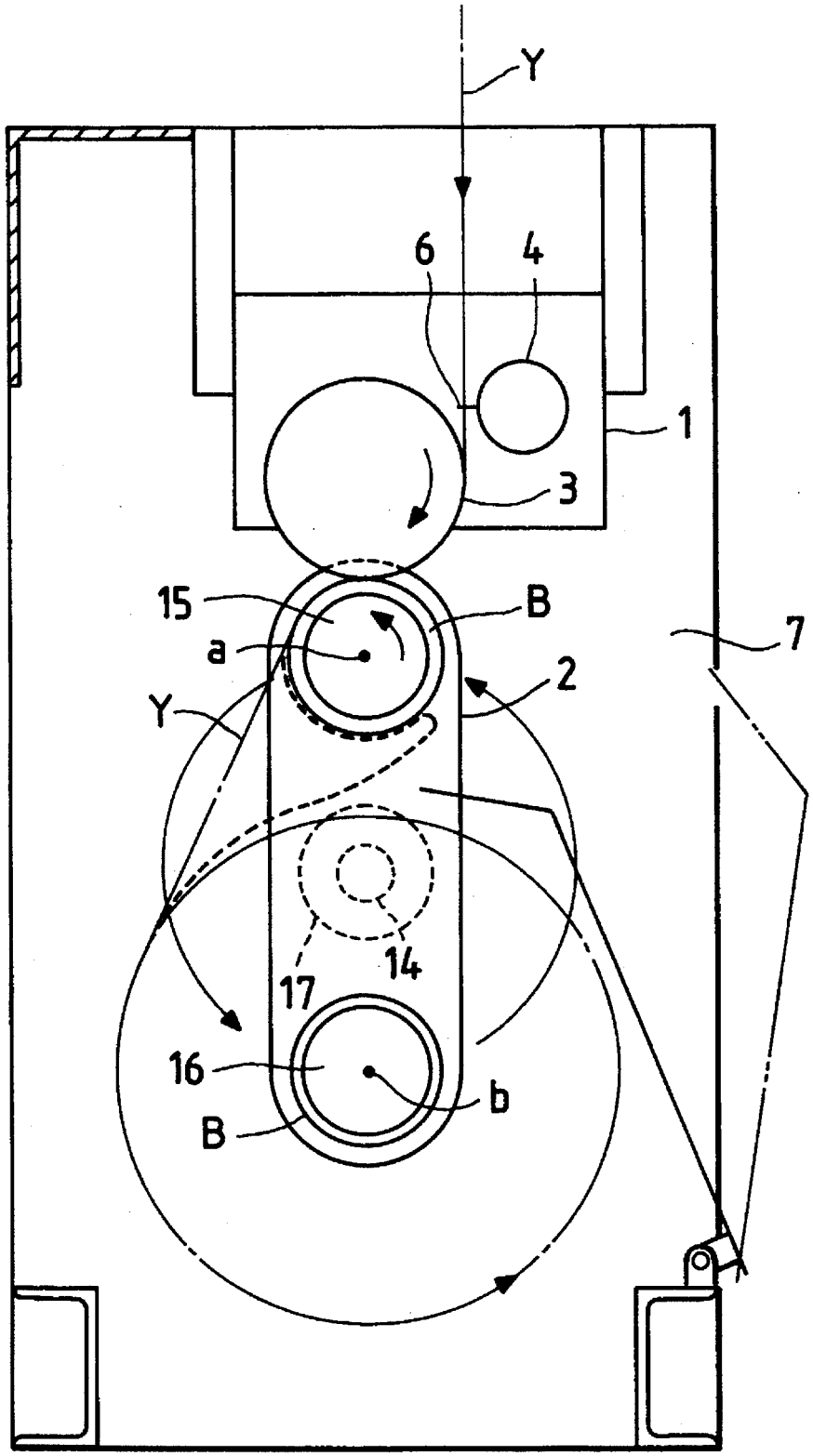
FIG. 6 PRIOR ART
FIG. 6 is a front view of a conventional winder showing the state of yarn transfer.

In FIG. 1, a difference of the winder from a conventional example shown in FIG. 6 resides in that a yarn transfer device 30 is added and bobbin holders 15 and 16 are not provided with a special quick-braking system. The winder is the same in other respects as that shown in FIG. 6, and therefore the same members as those used in the winder are designated by the same reference numerals and are not described.

The yarn transfer device 30 consists of a rocking arm 31 pivotally supported in an appropriate place of a machine frame 7, a swing arm 32 pivoted at the forward end of the rocking arm 31, and a guide bar 33 attached at the forward end of the swing arm 32.

The rocking arm 31 is rockable through an angle $\alpha$ on the center of a root shaft 34 by a driving means such as a rotary actuator not shown. The rocking arm 31 indicated by a solid line is in a retreat position, and the rocking arm 31 indicated by an alternate long and two short dashes line is in an operating position in which the shaft at the forward end thereof is positioned in the vicinity of a winding position a.

The swing arm 32 can be swung on the center of the root shaft 35 by a driving means such as a rotary actuator not shown. The swing arm 32 indicated by a solid line is located in a retreat position in which it faces immediately downwardly together with the rocking arm 31. The swing arm 32 indicated by an alternate long and two short dashes line swings from the initial position of operation, which is at the angle $\beta$ relative to the rocking arm 31, through about 270 degrees to the latter position of operation in a direction of the arrow 36.

The guide bar 33, which is attached on the forward end of the swing arm 32, has a guide groove 37 which the elastic yarn Y2 (the yarn stretched from the empty bobbin to the full bobbin) enters as shown in FIG. 3. The elastic yarn Y2 thus guided finally comes into contact, and is intertwined, with the elastic yarn Y1 being fed to the empty bobbin. The yarn Y1 and yarn Y2 denote a single yarn Y which is continuous to the empty bobbin. The numeral 8 denotes a separator which divides empty bobbins from full bobbins.

Next, the operation of the above-described yarn transfer device 30 will be described below. At the time of yarn transfer from the full bobbin B to the empty bobbin B, the turret 2 is rotated to the direction shown, to thereby press the elastic yarn Y against the surface of the empty bobbin B as shown in FIG. 1. The elastic yarn, therefore, runs on the surface of the empty bobbin B, and is snapped from the empty bobbin B, drawing a path stretching to the full bobbin B. Then, the yarn transfer device 30 is swung from the retreat position indicated by a solid line to the initial position of operation indicated by an alternate long and two short dashes line.

Then, the swing arm 32 is turned counterclockwise as shown in FIG. 2. The elastic yarn Y2 coming from the empty bobbin B to the full bobbin B is guided by the guide bar 33, being forcibly wound on the empty bobbin B. At the same time, the lifting box 1 goes upwardly and the touch roller 3 moves away from the empty bobbin B, thus forming an aerial yarn path of the elastic yarn Y1 being fed to the empty bobbin B. Furthermore, the peripheral speed of the empty bobbin B is increased 0 to 50%, thereby increasing the tension of the elastic yarn Y1 stretching to the empty bobbin B via the touch roller 3.

Then, when the swing arm 32 turns further to the direction of the arrow 38, the state of the guide bar 33 will be as shown in FIG. 3. The elastic yarn Y2 stretched from the empty bobbin B to the full bobbin B is restricted at one point in the guide groove 37. The elastic yarn Y1 going to the empty bobbin B, however, is reciprocated by the traversing device; furthermore when the swing arm 32 rotates, the elastic yarn Y2 restricted at one point contacts the elastic yarn Y1 which is reciprocating. The elastic yarns Y1 and Y2, having adhesion, are intertwined with each other when in contact. The elastic yarn Y2 stretched from the empty bobbin B to the full bobbin B is wound on the empty bobbin B together with the upstream elastic yarn Y1 of the empty bobbin B. The elastic yarn Y2 is continuously pulled until it is cut, thus completing yarn transfer.

For the yarn transfer device 30, various mechanisms may be adopted that suffice if the elastic yarn Y2 is wound by the guide bar 33 on the empty bobbin B located in the winding position a and is carried until it contacts the elastic yarn Y1 which is coming to the empty bobbin B.

The elastic yarn winder of the present invention is provided with a yarn transfer device in which the elastic yarn coming via the empty bobbin located in the winding position is wound on the full bobbin located in the waiting position and is brought into contact with the elastic yarn coming to the empty bobbin. These two yarns intertwine each other until the elastic yarn between the empty bobbin and the full bobbin is cut, completing yarn transfer. Therefore, it is possible to ensure yarn transfer simply by providing a yarn transfer device of simple construction, and without adding a special quick-braking system to the bobbin holder.

Figure 4:
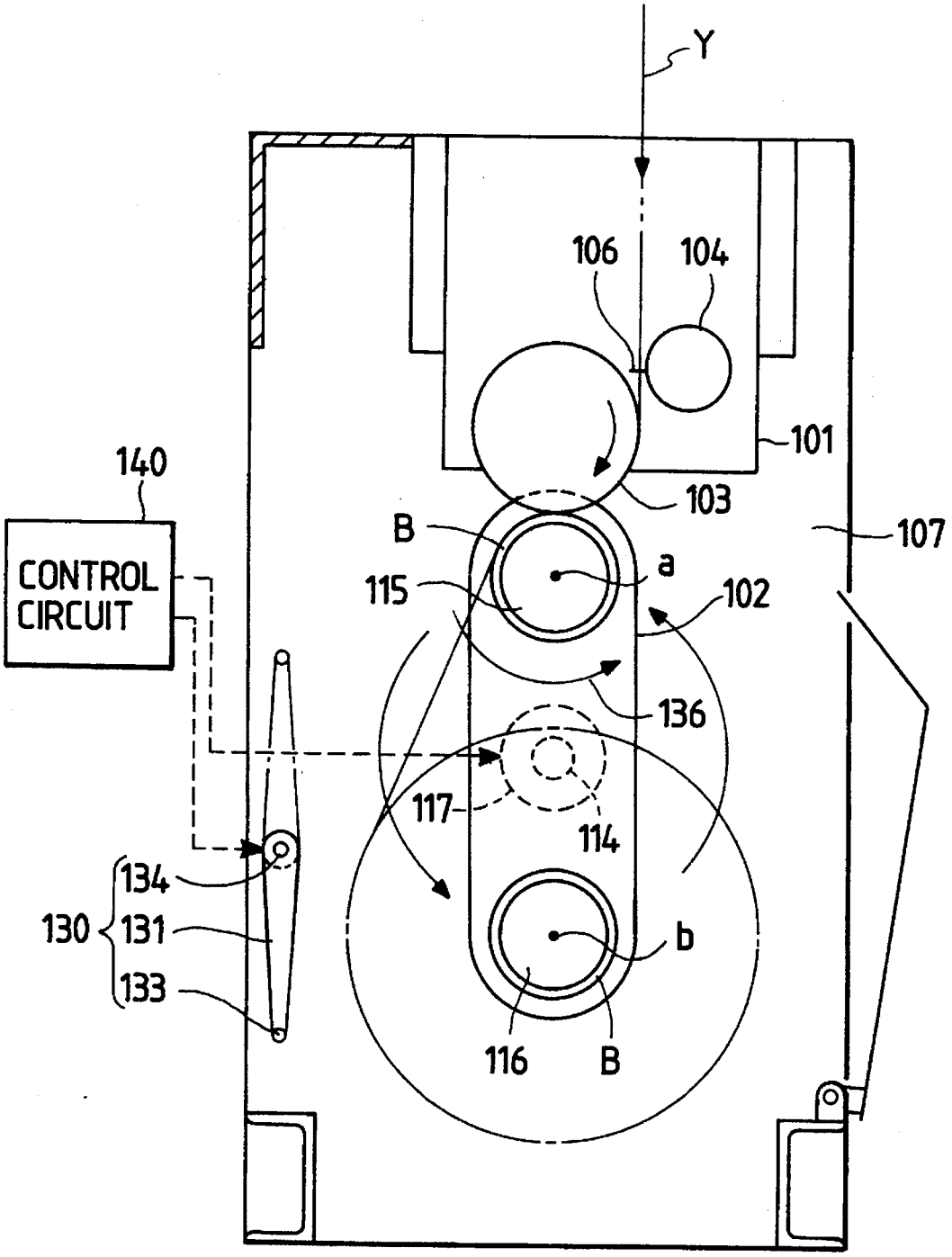
FIG. 4 is a front view of a second embodiment of the winder according to the present invention.

Next, the second embodiment of the winder according to the present invention will be explained with reference to FIGS. 4, 5 and 3. FIG. 4 is a front view showing the second embodiment of the winder, and FIG. 5 is a front view showing the states of the transfer mechanism of the winder during yarn transfer.

In FIG. 4, the winder differs from the conventional example of FIG. 6 in the respect that a yarn transfer device 130 and a control circuit 140 are additionally provided and that no special quick-braking system is employed for bobbin holders 115 and 116, and makes no difference in other respects from the conventional winder shown in FIG. 6.

The yarn transfer device 130 consists of a rocking arm 131 pivotally supported in the lower part of the machine frame 107, and a guide bar 133 attached on the forward end of the rocking arm 131. The shaft 134 of the rocking arm 131 is set in such a position that operation indicated by an alternate long and two short dashes line is enabled when the empty bobbin B115 is in an intermediate position c shown in FIG. 5D.

The rocking arm 131 is rotated through about 180 degrees on the center of the root shaft 134 by a driving means such as a rotary actuator not shown; the rocking arm 131 indicated by a solid line is in the retreat position, while the rocking arm 131 indicated by an alternate long and two short dashes line is in the operating position.

The guide bar 133 is installed on the forward end of the rocking arm 131, and has a guide groove 137 in which the elastic yarn Y2 (the yarn coming from the empty bobbin to the full bobbin) fits as shown in FIG. 3. The elastic yarn Y2 thus guided contacts, and is intertwined with, the elastic yarn Y1 which finally comes to the empty bobbin.

The control circuit 140 controls the driving means, such as the rotary actuator not shown, of the yarn transfer device 130, and an induction motor 117 for driving the turret 102.

Figure 5A:
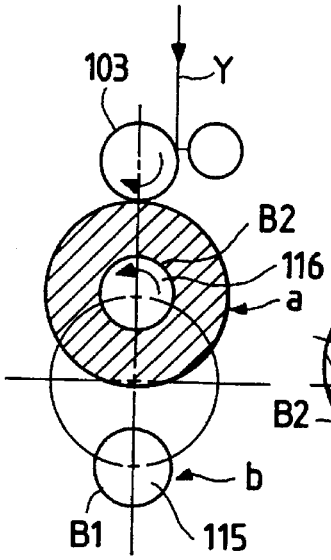
FIGS. 5A to 5F are front views of the winder showing the state of yarn transfer.
Figure 5B:
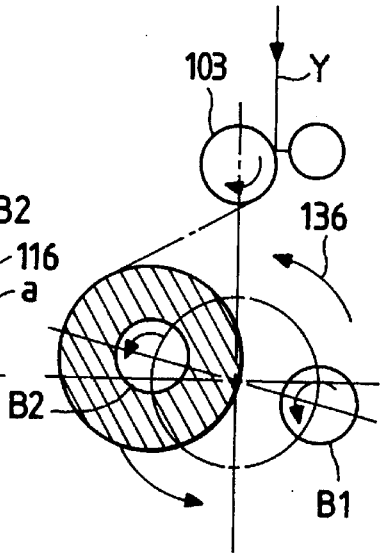
Figure 5C:
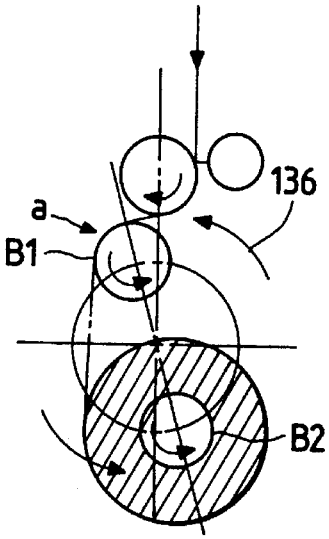
Figure 5D:
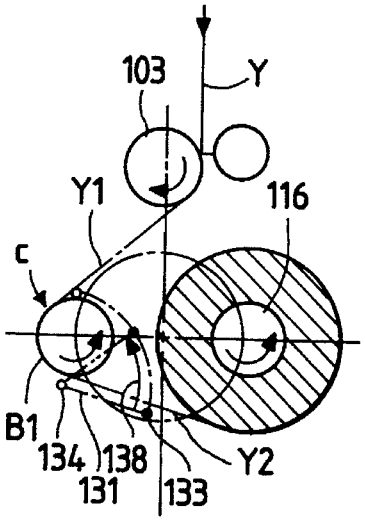

Subsequently, the operation of the above-described winder will be explained with reference to FIG. 5. In FIG. 5A, when the time assigned for changing the yarn from the full bobbin B2 to the empty bobbin B1 is reached, the turret is rotated in the direction of the arrow 136 as shown in FIG. 5B, rotating the empty bobbin B1 even after passing the winding position a as shown in FIG. 5C. Then, when the empty bobbin B1 has reached the intermediate position (a position where the full bobbin and empty bobbin are arranged in horizontal position) c between the winding position and the waiting position as shown in FIG. 5D, the turret stops rotating. At this time, the elastic yarn Y runs while being pressed against the surface of the empty bobbin B1, then being broken from the empty bobbin B1. The elastic yarns Y1 and Y2 draw the paths Y1 and Y2 to the full bobbin B2 and their winding angle becomes one-third or over of the whole circumference.

Then the rocking arm 131 is rotated in the counterclockwise direction. The elastic yarn (outgoing side) Y2 coming from the empty bobbin B1 to the full bobbin B2 is guided by the guide bar 133, being forcibly wound on the empty bobbin B1. At the same time the peripheral speed of the empty bobbin B1 is raised to increase the tension of the elastic yarn (incoming side) Y1 which comes to the empty bobbin B1 via the touch roll 103.

The rocking arm 131, when rotated in the direction of the arm 138, becomes as shown in FIG. 3. The elastic yarn Y2 stretched from the empty bobbin B1 to the full bobbin B2 is restricted at one point in the guide groove 137, while the elastic yarn Y1 coming to the empty bobbin B1 is reciprocated by the traversing device. With further rotation of a rocking arm 132, the elastic yarn Y2 restricted at one point and the reciprocating elastic yarn Y1 contact each other. Here, the angle of rotation required for the rocking arm 132 may be small because of a large angle of initial contact of the elastic yarn Y2. The elastic yarns Y1 and Y2, when contacting each other, are entwined with each other as they are adhesive elastic yarns. The elastic yarn Y2 coming from the empty bobbin B1 to the full bobbin B2 is rolled onto the empty bobbin B1 together with the elastic yarn Y1 which goes to the empty bobbin B1. Then, the elastic yarn Y2 is elongated continuously, being finally broken to thereby complete yarn transfer.

Figure 5E:
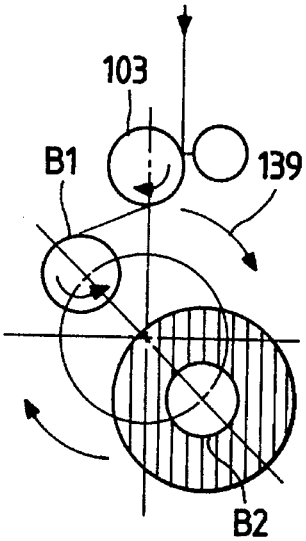
Figure 5F:
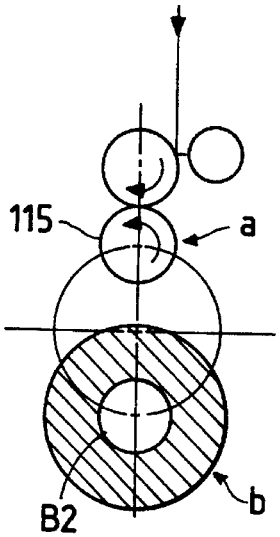

Upon the completion of yarn transfer, as shown in FIG. 5E, the turret rotates reversely in the direction of the arrow 139, and then, as shown in FIG. 5F, the empty bobbin B1 comes in the winding position a, being reset to ordinary winding control.

It is also conceivable that yarn transfer shown in FIG. 5D is performed in the winding position shown in FIG. 5F; in this case, however, the yarn transfer device has such a disadvantage that the adoption of a mechanism for retreating the guide bar 133 from the path of movement of the full bobbin B2 is accompanied by the complication of the construction of the rocking arm 131.

The construction of the yarn transfer device 130 suffices if only the guide bar 133 winds the elastic yarn Y2 on the empty bobbin B1 in the intermediate position c and carries the elastic yarn Y2 until it contacts the elastic yarn Y1 coming to the empty bobbin B1. Various mechanisms satisfying the above condition, therefore, can be adopted. Furthermore, the yarn transfer device 130 may be of such a construction that the elastic yarn Y2 is pinched to be attached on, and to turn together with, the empty bobbin B1, thus contacting, and being entwined with, the elastic yarn Y1 coming to the empty bobbin B1.

According to the method and winder for winding an elastic yarn of the present invention, an empty bobbin is stopped in an intermediate position past a winding position, and in this position the elastic yarn on the outgoing side of the empty bobbin is wound on the bobbin and, at the same time, is brought into contact with the elastic yarn on the incoming side. Thus the elastic yarns are intertwined each other, and the elastic yarn between the empty bobbin and the full bobbin is broken, completing yarn transfer. It is, therefore, possible to reliably perform yarn transfer simply by adding a simple control means and a yarn transfer device of simple construction and without providing the bobbin holder with a special quick-braking device. Particularly because the empty bobbin is stopped in the intermediate position, the winding angle of the elastic yarn on the empty bobbin becomes large, thereby decreasing the angle of rotation required for yarn transfer and consequently facilitating yarn transfer. Furthermore, since it is possible to provide a wide space around the empty bobbin, the yarn transfer device can be simplified in construction without spatial limitation, and moreover varieties of yarn transfer devices are usable.

What is claimed is:

1. A method for winding elastic yarn in succession upon at least two bobbin holders, comprising the steps of:

a) providing at least two bobbin holders having bobbins thereon;

b) feeding an elastic yarn from an upstream location and winding the elastic yarn around a first of said bobbins until said first bobbin is full;

c) contacting a second of said bobbins, which is empty, against said yarn upstream of said first bobbin such that the yarn extends from the upstream location around the second bobbin and extends from the second bobbin to said first bobbin which is full;

d) positioning a portion of the yarn which, after said step c), extends from the second bobbin to said first bobbin in contact against a portion of the yarn upstream of the second bobbin such that the yarn surrounds the second bobbin, whereby the portions of elastic yarns become intertwined;

e) winding the elastic yarn around the second bobbin such that the elastic yarn which extends from the second bobbin to said first bobbin is pulled until it breaks so as to complete the yarn transfer between said first and second bobbins.

2. An elastic yarn winding method as claimed in claim 1, further including holding said empty second bobbin spaced from a touch roller at the time of yarn transfer from said first full bobbin to said second empty bobbin.

3. An elastic yarn winding method as claimed in claim 2, further including stopping said second empty bobbin in an intermediate position between a waiting position and a winding position, and transferring said elastic yarn at an outgoing side of said second empty bobbin by winding on said second bobbin in said intermediate position.

4. An elastic yarn winding method as claimed in claim 1, wherein said step of contacting a portion of the yarn which extends from the second bobbin to said first bobbin against a portion of the yarn upstream of the second bobbin includes restricting said portion of the yarn which extends from the second bobbin to said first bobbin from lateral movement in a direction parallel to an axis of rotation of the second bobbin, while reciprocating a portion of the yarn upstream of the second bobbin in said direction parallel to an axis of rotation of the second bobbin such that the portions of the elastic yarn are contacted and by the adhesion of the elastic yarns the elastic yarns are intertwined with each other.

5. An elastic yarn winding method as claimed in claim 1, wherein said step of restricting said portion of the yarn which extends from the second bobbin to said first bobbin from lateral movement in a direction parallel to an axis of rotation of the second bobbin includes supporting said latter portion in a guide groove in a guide bar which is moved to bring said latter portion to said portion of the yarn upstream of the second bobbin.

* * * * *